United States Patent [19]

Sanders et al.

[11] 4,453,743

[45] Jun. 12, 1984

[54] DIARY WITH COMBINATION-CONTROLLED LOCK

[75] Inventors: Robert E. Sanders, Lenexa, Kans.; Bernard P. Seibolt, Kansas City, Mo.

[73] Assignee: Hallmark Cards, Incorporated, Kansas City, Mo.

[21] Appl. No.: 316,864

[22] Filed: Oct. 30, 1981

[51] Int. Cl.[3] ..... B42D 3/10; E05B 55/02; E05B 65/52

[52] U.S. Cl. ..... 281/18; 70/57; 70/64; 70/67; 312/216

[58] Field of Search ..... 281/36, 37; 70/63, 64, 70/67, 158, 160, 167, 286, 159, 19, 5, 57, 312, 314, 302; 206/1.5; 402/2; 190/56; 312/216

[56] References Cited

U.S. PATENT DOCUMENTS

| | | | |
|---|---|---|---|
| 517,729 | 4/1894 | Cable | 70/57 X |
| 555,829 | 3/1896 | Rogers | 70/57 X |
| 678,060 | 7/1901 | Switzer | 70/19 UX |
| 812,073 | 2/1906 | McDonald | 312/216 |
| 1,612,315 | 12/1926 | Ramanauskas | 70/64 |
| 2,072,076 | 3/1937 | Awiszus | 70/64 X |
| 2,271,204 | 1/1942 | Peters | 70/67 X |

*Primary Examiner*—E. R. Kazenske
*Assistant Examiner*—Taylor J. Ross
*Attorney, Agent, or Firm*—Neuman, Williams, Anderson & Olson

[57] ABSTRACT

A combination-controlled lock assembly for use with a journal or book, such as a diary, which comprises a lock housing, a first cover clamp securing the housing to one book cover, a second cover clamp affixed to the other book cover and having a latch element thereon which is intermateable with said housing, a latching plate slidably disposed within said housing, said plate having an open hook-shaped receptacle aligned for intermating with said latch element and slidable with said plate between a latching position and a retracted position, and combination-controlled means for selectively enabling the latching plate to slide within said housing between said positions.

6 Claims, 5 Drawing Figures

DIARY WITH COMBINATION-CONTROLLED LOCK

FIELD OF THE INVENTION

This invention relates generally to security locks for books and, in particular, to a combination-controlled lock for ensuring the security of the contents of diaries or the like.

BACKGROUND OF THE INVENTION

The contents of diaries, books or other journals are typically secured from intrusion and unwanted inspection by the use of key locks. Key locks can be attached to books or incorporated into book covers in a variety of ways. Generally, a lock receptacle is attached close to the opening edge, which is opposite, but parallel to the hinging edge of one cover of the book. A hasp or latching element is hinged, strapped or clamped to the other cover of the book so that the hasp can be latched to the lock receptacle when the book is in a closed condition. If security from intrusion and unwanted inspection of the contents is desired, the lock receptacle is locked with the key preventing release of the latched hasp.

The major drawback associated with existing book locking systems that utilize key lock receptacles is that of lost or missing keys.

Padlock arrangements for books or diaries using separate key or combination-controlled locks have the disadvantage of being bulky, making the storage and handling of the books or diaries cumbersome. Furthermore, since the lock is not integrally connected with the book, the possibility of a lost or misplaced lock exists.

The unavailability in the art of a combination-controlled lock exhibiting the advantages of small size, simplicity, proper integration with the book structure and ease of operation is apparent. Conventional combination-type locks are often complex and cumbersome. As a result, there is a need for a combination-controlled lock for books or diaries that is small in size and which does not unnecessarily increase the bulk or weight of the book.

Accordingly, it is a primary object of the present invention to provide a security system for diaries or the like that is unitary with the book or diary and which does not have separate or loose parts, thus eliminating the possibility of loss of those parts.

It is another object of this invention to provide a diary or book combination-controlled lock that is small in size and which does not unnecesarily increase the bulk or weight of the book, thereby facilitating storage.

It is still another object to provide a book with a combination-controlled security system that is self-contained between the covers of the book which facilitates stacking and storage of the books.

It is a further object of this invention to provide a combination-controlled diary lock that utilizes a minimum number of moving parts, thus reducing the complexity and expense of manufacture while enhancing reliability and ease of operation.

BRIEF SUMMARY OF THE INVENTION

The above and other objects and advantages are achieved by the present invention through the provision of a combination-controlled lock mechanism which is formed integral with the covers of a book, such as a diary. The combination-controlled lock assembly of the invention comprises a lock housing, a first cover clamp securing the housing to one book cover, a second cover clamp affixed to the other book cover and having a latch element thereon which is intermateable with said housing, a latching plate slidably disposed within said housing, said plate having an open hook-shaped receptacle aligned for intermating with said latch element and slidable with said plate between a latching position and a retracted position, and combination-controlled means for selectively enabling the latching plate to slide within said housing between said positions.

The lock mechanism in its preferred form has a combination-controlled latch receptacle hinged to one of the covers and pivotable into engagement with a mating latch element on the other of the covers. The combination-controlled receptacle houses an internal latching plate, a leaf-type spring, and two camming discs.

The internal latching plate is contained within a substantially rectangular box-like housing. The top wall of the housing has a slot which opens to a hook-shaped receptacle on the internal latching plate so that a latch element, integral with a hasp or clamp attached to one cover, can pass through the slot in the housing and engage the hook-shaped receptacle. Means are also provided to allow manual control of the latching plate between a latched or operative position and a retracted or open position.

The camming discs are respectively mounted for rotation on opposite inside surfaces of the housing and in axial alignment with each other within a cutaway portion or aperture of the latching plate. Due to their irregular shape and the manner in which they coact with each other, the discs can be aligned by a proper combination of manual movements on a dial so as to allow transfer of the plate between its engaged position and a retracted position relative to the path of the latch element. The receptacle housing, as well as its clamp holder and the latch element are sized and shaped to fit substantially within the exterior dimensions of the book itself, thereby facilitating the storage and handling of the book.

BRIEF DESCRIPTION OF THE DRAWINGS

For a more complete understanding of this invention, reference should now be made to the embodiment illustrated in greater detail in the accompanying drawings.

In the drawings.

DESCRIPTION OF THE PREFERRED EMBODIMENTS

Figure 1:
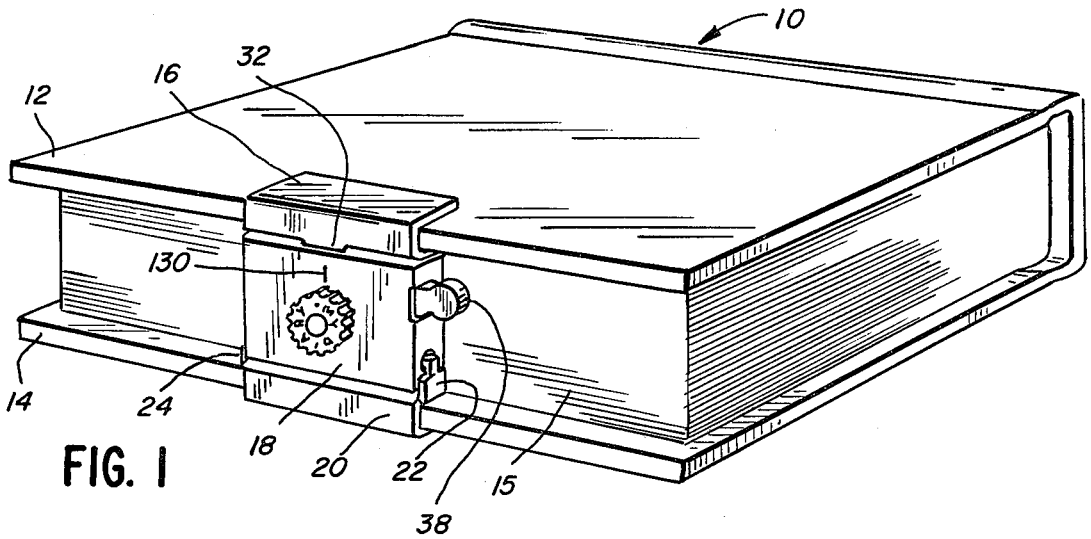
FIG. 1 is a perspective view of a book, such as a diary, having a combination-controlled lock assembly constructed in accordance with the present invention and maintaining the book in a latched closed condition.

Turning now to the drawings, FIG. 1 shows a book, such as a diary 10, having a front cover 12, a rear cover 14 and a plurality of pages 15, the edges of which are somewhat recessed from the edges of covers 12 and 14.

The lock assembly generally includes a first U-shaped cover clamp 16 with a latch element 32 affixed thereto, a second U-shaped cover clamp 20 and a lock receptacle housing 18 hingedly mounted to the cover clamp 20. The U-shaped cover clamps 16 and 20 are adapted to slidably engage the ends of book covers 12 and 14, respectively. The lock receptacle housing fits snugly between the covers 12 and 14 in the recess provided along the edges of the pages 15 so as to present minimal outward protrusion. Emanating from the housing are the manual controls for the lock including a combined dial and indicator wheel 102 and a control arm 38.

Engagement of the latch element 32 and thus the cover 12 in the lock receptacle housing 18 is controlled by inward and outward movement of an internal latch mechanism via the control arm 38 while the dial indicator wheel 102 selectively enables or disables the operation of the control arm 38 and the latch mechanism in a manner to be described more fully hereinafter.

Figure 2:
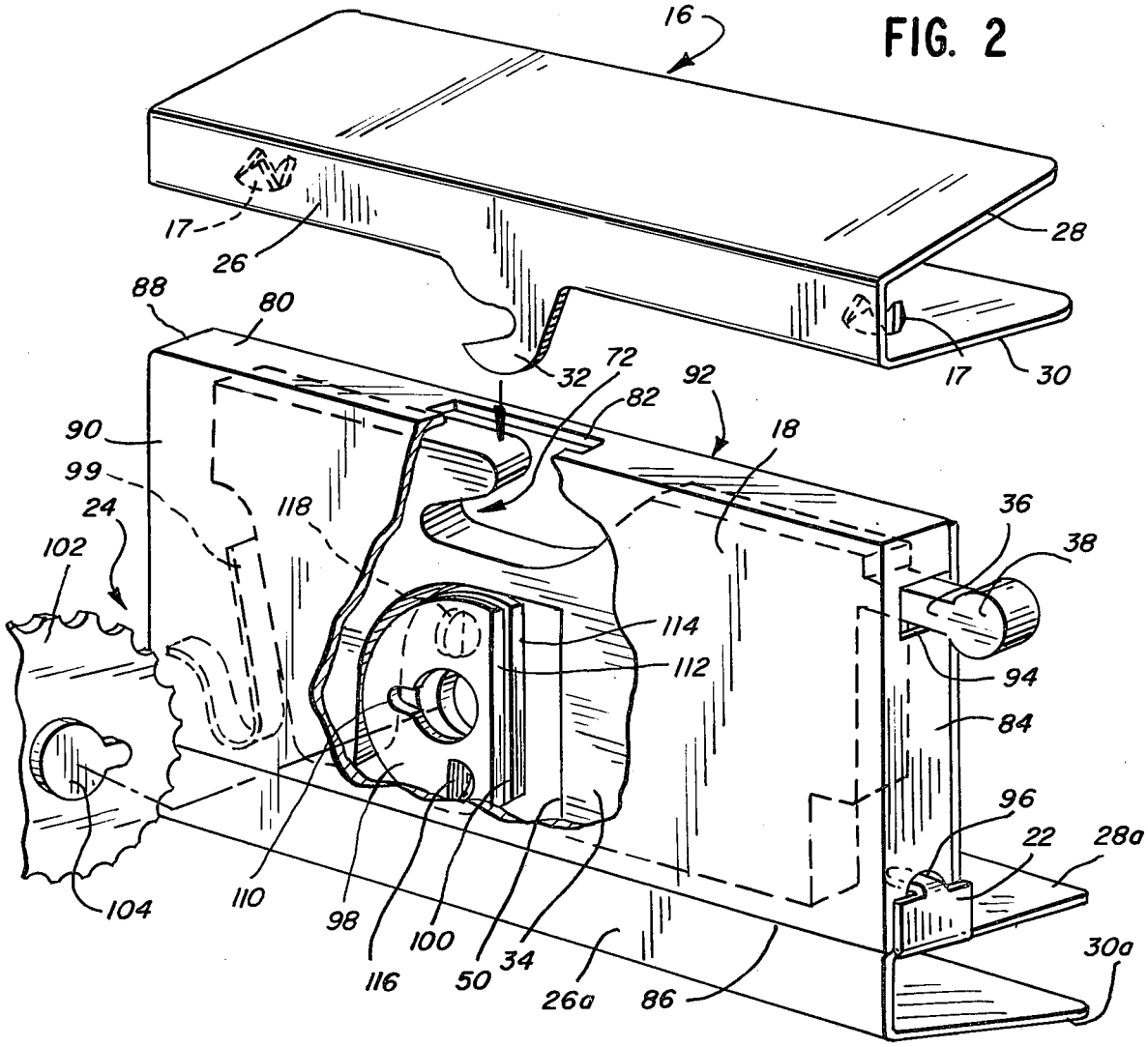
FIG. 2 is a perspective view of the elements of the combination-controlled lock assembly of this invention which is partially cut away to show the internal mechanism of the lock in receptive position prior to closing of the book.
Figure 3:
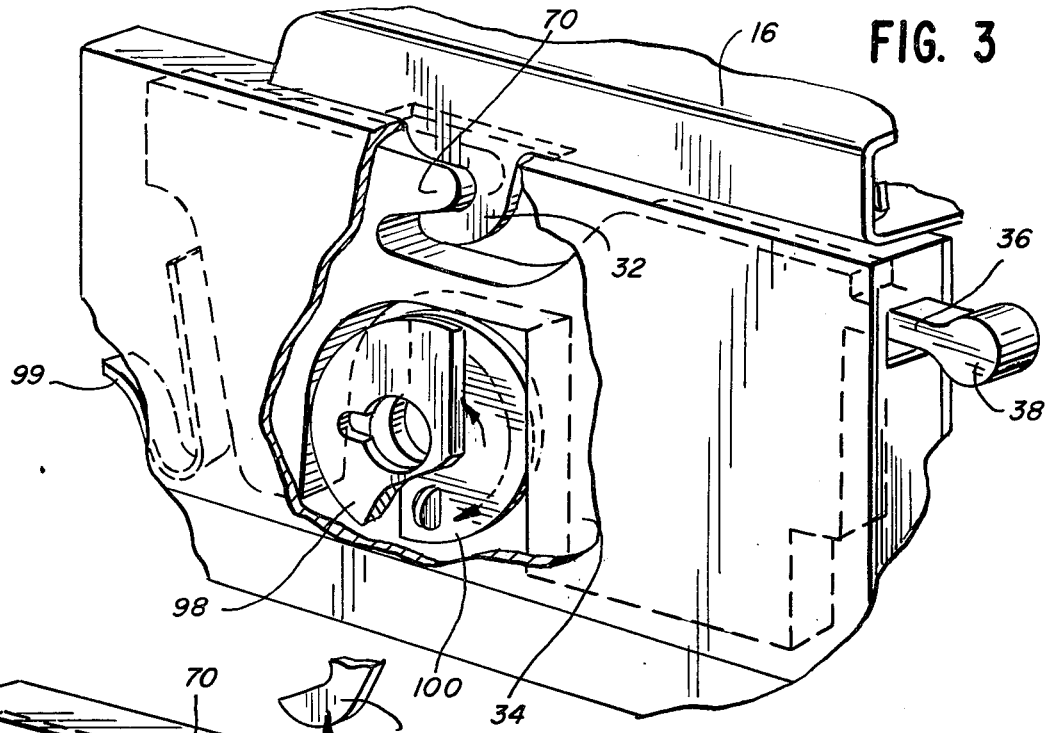
FIG. 3 is a perspective and partially cutaway view of the combination-controlled lock assembly of this invention with the latch element engaged in the locked and closed position.
Figure 4:
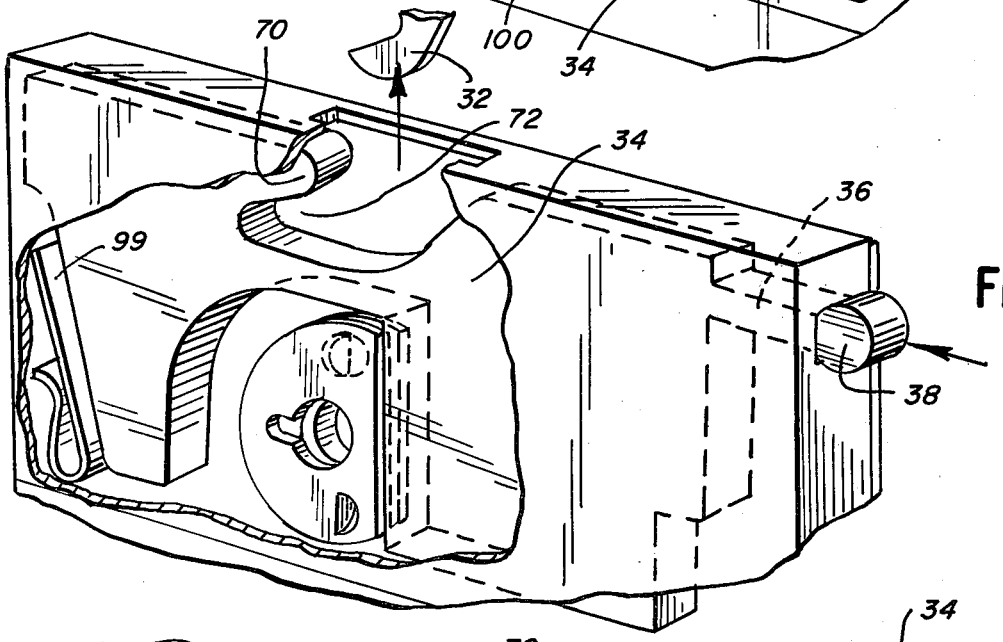
FIG. 4 is a perspective and partially cutaway view of the combination-controlled lock assembly of this invention showing the internal mechanism retracted to allow release of the latch element.

The details of the combination-controlled lock assembly will be further apparent from the cutaway illustration of FIGS. 2, 3, and 4, which show the assembly in its three principal states of operation.

Referring first to FIG. 2, the cover clamp 16 has a substantially U-shaped cross section which is formed by a vertical end plate 26, a first side plate 28 and a second side plate 30 defining a U-shaped open end which is fitted over the front cover 12 of the book 10. A plurality of tines 17 are struck from the second side plate 30 and act to penetrate the cover 12 when the clamp 16 is crimped around the cover, thereby securing the two elements together. The hooked latch element 32 is an integral portion of the cover clamp 16 and extends vertically downward therefrom.

The second cover clamp 20 is similar to cover clamp 16 and has a substantially U-shaped cross section formed by vertical end plate **26*a*, a first side plate 28*a* and a second side plate 30*a* defining a U-shaped open end which is fitted over rear cover 14 of book 10**.

The second cover clamp 20 is crimped to book cover 14, and held thereto by tines (not shown) penetrating the cover from within.

The substantially rectangular box-like receptacle housing 18 is pivotally mounted to the cover clamp 20 by means of hinges 22 and 24 which are axially aligned and located on opposite ends of the housing 18. The hinge elements 22 and 24 are preferably formed integral with the cover clamp 20 and are L-shaped tabs bent upwardly therefrom at an angle of 90°.

As an important feature of the present invention, the latch receptacle is provided with a combination-type locking mechanism that utilizes a minimum number of parts for simplicity of design, manufacture, use and maintenance.

The lock receptacle housing 18 is an external housing which is of a thin, flat rectangular configuration adapted to fit within the recess between the covers 12 and 14 of the book. The housing is preferably made of thin sheet metal in two parts and sandwiched together to complete the assembly in a manner described below. The book receptacle housing encompasses a latching plate 34 adapted to selectively engage the latch element 32 and a spring 99 for biasing the latching plate 34 into engagable position with latch element 32. Camming discs 98 and 100 are responsive to positioning by the dial indicator 102 and adapted to enable or disable the movement of the latching plate 34 between open and locked operating positions.

As shown in FIGS. 2, 3 and 4, the housing 18 has a top side 80 provided with a slot 82. A hook-shaped pocket 72 of the latching plate 34 substantially subtends the slot 82 so that the latching element 32 on cover clamp 16 can engage a nose 70 of the latching plate 34. The lock receptable housing 18 has a right side 84, a bottom side 86, a left side 88, a front side 90 and a back side 92. The right side 84 is provided with a substantially square hole 94 to accommodate the control arm 38 on the latching plate 34. Close to the bottom side 86, the right side 84 of lock receptable housing 18 is provided with a hole 96 to accommodate the hinge element 22. A similar hinge hole is provided on the left side 88 for accommodating hinge element 24.

The receptable housing 18 has an interior space and height only slightly larger than the external dimensions of the latching plate 34. However, the lateral or longitudinal dimensions of the housing interior are substantially greater than the corresponding dimensions of the latching plate 34 so that the plate 34 can slide longitudinally within the housing 18 under the control of the control arm 38 emanating from the hole 94. The spring element 99 biases the plate 34 toward its right-most position, in which the nose 70 is in its latched or closed position for retention of the latch element 32 of the cover clamp 16. An inward force on the control arm 38 forces the plate to the left, or retracted position, against the force of the spring 99, opening the hook-shaped pocket 72 and releasing the latching element 32 on the cover clamp.

Figure 5:
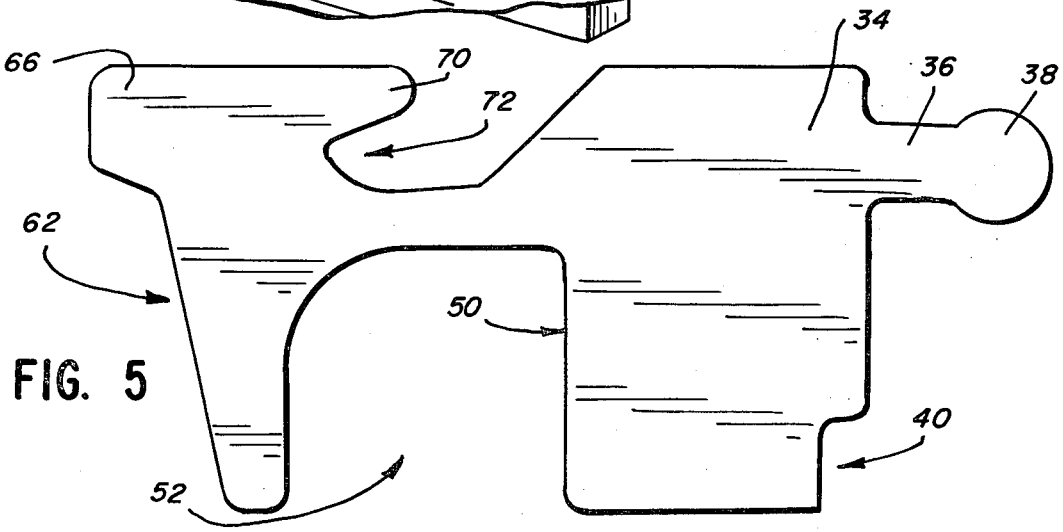
FIG. 5 is a front plan view of the internal latching plate of the combination-controlled lock assembly of this invention.

The latching plate 34 has a plurality of operative portions normally requiring multiple components in conventional lock designs. Shown more specifically in FIG. 5, the latch plate 34 is irregularly shaped and has the hook-shaped pocket 72 with the nose 70 for selectively engaging the latch element 32. Additionally, it has a portion indicated by numeral 62 which tapers inwardly to provide space for spring 99 within the housing 18. Also, latch plate 34 is recessed as at 40 to provide a space for the hinge element 22 and a primary pocket or lock aperture 52 for the combination-controlled camming discs 98 and 100. An operative element of the lock aperture 52 is its right camming edge 50 whose function is later described. Finally, the latch plate 34 has a first protrusion 36 defining the control arm 38 and a second protrusion 66 from the opposite end which extends toward the wall 88 of housing 18 (FIG. 2) and defines the limits of travel of the latching plate 34.

Movement of the latching plate 34 between its closed and retracted positions is controlled by a combination-controlled lock mechanism integrated with the housing 18 and including front and rear camming discs 98, 100 and the dial indicator wheel 102.

The front camming disc 98 and rear camming disc 100 are shown in coaxial alignment within the primary pocket 52 of latch plate 34. The rear camming disc 100 is rotatably and fixedly attached to the back side 92 of the housing 18 by an eyelet struck from the rear of the housing or by any other suitable pivot fastener. The dial indicator wheel 102 has a keyed axle 104 and is suitably mounted on the front side 90 of the housing 18 so that it is rotatable but fixedly attached thereto in axial alignment with the rear camming disc 100. The keyed axle 104 engages a keyed eyelet 110 in the front camming disc 98 and is secured thereto by press fitting, welding or other bonding techniques. The front camming disc 98 is absent an edge segment, forming a flat camming surface 112. Similarly, the rear camming disc 100 is absent a substantially identical edge segment, forming a flat camming surface 114. Suitable means are provided to allow the camming discs 98 and 100 to selectively engage one another under the control of dial indicator wheel 102. To this end, the front camming disc 98 has a protuberance 116 perpendicular to the plane of the cam and pointing toward the back side 92 of the housing 18. In radial alignment with the protuberance 116 is a protuberance 118 perpendicular to the plane of and located on the rear camming disc 100. The protuberance 118 points toward the front side 90 of the housing 18.

To further explain the operation of the combination-controlled lock assembly, reference is again made to FIGS. 2, 3 and 4, illustrating the three operable conditions of the assembly. In FIG. 2, the latch plate 34 is in position for receiving latch element 32, the camming discs 98 and 100 being aligned with their camming surfaces 112 and 114 parallel to and adjacent the flat right camming edge 50 of the lock aperture 52 in latch plate 34. In this position, the latch plate 34 is freely slidable against the spring 99 as the latch element 32 moves downward into engagement with the nose 70 of latch plate 34.

FIG. 3 shows the latch element 32 locked in position, engaged by the nose 70 on latch plate 34. In the position shown, the flat camming surfaces 112 and 114 of the front and rear camming discs 98 and 100 have been reoriented so that they are neither in parallel coplanar alignment nor facing parallel alignment with the camming edge 50. This being the case, either or both of the camming discs prevents movement of the latch plate 34 thereby maintaining the nose 70 in engaged position with latch element 32.

FIG. 4 shows the cover clamp 16 being disengaged and in opening position, the latching plate 34 being in retracted position. The flat camming surfaces 112 and 114 are again in parallel coplanar alignment and in parallel facing alignment adjacent the camming edge 50, allowing the control arm 38 to move the plate 34 to the left, disengaging the latch element 32 from nose 70. While the camming discs 98 and 100 are aligned in the unlocked position and control arm 38 is released, the spring 99 urges the plate 34 to its closed but unlocked position.

The combination of movements necessary to align the flat camming surfaces 112 and 114 in parallel coplanar alignment and parallel to and facing the camming edge 50 of the latching plate 34 is as follows. First, the dial indicator wheel 102 is rotated counterclockwise through at least 360° and until alignment is achieved between a hatch mark 130 (FIG. 1) and a predetermined letter or number on the wheel 102, said alignment corresponding to the parallel facing alignment of the flat cam surface 114 of the rear camming disc 100 and the camming edge 50 of the plate 34. At least 360° of rotation is necessary to ensure that the protrusion 118 on the rear disc 100 is properly engaged by the protuberance 116 on the front disc 98. Once the rear camming disc 100 is in position, the wheel 102 is turned in a clockwise direction until another number or letter aligns with the hatch mark 130, representing the parallel coplanar alignment of the flat cam surface 112 of the front camming disc 98 with the flat cam surface 114 of the rear camming disc 100 and facing parallel orientation with the camming edge 50. In this position, the latch plate 34 can now be moved to the left by moving the control arm 38, allowing engagement or disengagement of the latching element 32 and the nose 70. A random turn of the wheel 102 will thereafter scramble the camming discs and preclude movement of latch plate 34 once again.

The embodiment illustrated in the drawings shows the protuberances 116 and 118 located on camming discs 98 and 100 to be in one particular relationship. It should be appreciated that an infinite variety of positions of the protuberances along circular arcs of the same radii on their respective cams is possible. Depending upon the method of manufacture, modifications may also be achieved by altering the locations for the flattened segments on either or both of the discs 98 or 100 or by altering the angle of the indicia on the dial wheel 102.

While a particular embodiment of the invention has been shown, it will be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

What is claimed is:

1. A selectively securable book-like structure comprising:

a book-like structure having front and back covers spaced to enclose a plurality of pages, a lock housing, a first cover clamp for securing the lock housing to one of said covers, a second cover clamp for securing the lock housing to the second of said covers and having a latch element thereon which is intermateable with said lock housing, a latching plate disposed within said lock housing and being slidable therein between a latching position and a retracted position, and combination-controlled means for selectively enabling the latching plate to slide within said housing between said positions, wherein said combination-controlled means comprises a camming edge on said latching plate and a pair of camming discs axially aligned adjacent said camming edge of the plate, said discs each having a flattened, planar surface portion along a chord line thereof so that when said planar surface portions of said discs are aligned in a common plane adjacent said camming edge of the plate, lateral movement of said plate away from its latching position is enabled.

2. A selectively securable book-like structure comprising:

a book-like structure having front and back covers spaced to enclose a plurality of pages, a lock housing, a first cover clamp for securing the lock housing to one of said covers, a second cover clamp for securing the lock housing to the second of said covers and having a latch element thereon which is intermateable with said lock housing, a latching plate disposed within said lock housing and being slidable therein between a latching position and a retracted position, and combination-controlled means for selectively enabling the latching plate to slide within said housing between said positions, wherein said combination-controlled means includes a pair of camming discs aligned along an axis which is perpendicular to the slide path of said plate, said discs having flattened camming surface portions which may be aligned to reduce the effective diameter of the discs along said slide path, and said plate having a cutaway pocket portion surrounding said discs such that said discs prevent the sliding of said plate when said flattened camming surface portions are misaligned while enabling said plate to slide while said flattened camming surface portions are in predetermined alignment.

3. A selectively securable book-like structure according to claim 2 wherein the combined thickness of said discs is less than the thickness of said slidable plate.

4. A selectively securable book-like structure according to claim 2 wherein said housing has inside and outside walls between which said plate is slidable and wherein a first of said camming discs is coupled to the inside wall while the second disc is coupled to said outside wall.

5. A selectively securable book-like structure according to claim 4 further including a hand control dial wheel axially aligned and coupled with the second of said camming discs and operative to control rotation of said second disc from outside of said housing.

6. A selectively securable book-like structure according to claim 5 wherein each of said discs has a protuberance projecting toward the other disc, said protuberances being radially aligned to interfere with each other such that the first disc is rotatable by the second disc whenever said protuberances are in contact.

* * * * *